US009039439B2

(12) United States Patent
Alden, III

(10) Patent No.: US 9,039,439 B2
(45) Date of Patent: May 26, 2015

(54) INTERCONNECT DEVICE

(71) Applicant: Tyco Electronics Corporation, Berwyn, PA (US)

(72) Inventor: Wayne Stewart Alden, III, Whitman, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 251 days.

(21) Appl. No.: 13/838,944

(22) Filed: Mar. 15, 2013

(65) Prior Publication Data

US 2014/0273600 A1 Sep. 18, 2014

(51) Int. Cl.
*H01R 13/62* (2006.01)
*H01R 12/91* (2011.01)

(52) U.S. Cl.
CPC ..... *H01R 12/91* (2013.01)

(58) Field of Classification Search
USPC ..... 439/370, 88, 345, 330–331, 66–67, 82, 439/70–73, 79, 342
See application file for complete search history.

(56) References Cited

U.S. PATENT DOCUMENTS

| | | | | |
|---|---|---|---|---|
| 5,073,116 | A * | 12/1991 | Beck, Jr. | 439/71 |
| 6,210,197 | B1 * | 4/2001 | Yu | 439/342 |
| 6,733,304 | B1 * | 5/2004 | Liao | 439/66 |
| 6,945,794 | B1 * | 9/2005 | Yang et al. | 439/73 |
| 7,666,029 | B2 * | 2/2010 | Lin | 439/526 |
| 7,871,275 | B1 * | 1/2011 | McClellan et al. | 439/71 |
| 7,950,946 | B2 * | 5/2011 | Liao et al. | 439/330 |
| 2009/0075512 | A1 * | 3/2009 | Liao et al. | 439/345 |
| 2009/0124100 | A1 * | 5/2009 | Mason et al. | 439/66 |
| 2012/0257366 | A1 | 10/2012 | Mason et al. | |
| 2013/0330960 | A1 | 12/2013 | Mason et al. | |

* cited by examiner

*Primary Examiner* — Jean F Duverne

(57) ABSTRACT

An interconnect device includes a contact assembly having a carrier holding an array of conductors configured to provide an electrical path between first and second electrical components. The interconnect device includes a frame defining a receiving space configured to receive the first electrical component therein. The frame includes corner frames configured to engage the first electrical component to locate the first electrical component within the receiving space. Each of the corner frames includes a base and an engagement member configured to engage the first electrical component as the first electrical component is received into the receiving space. The engagement member is configured to be resiliently deflected toward the base in a compliance direction via engagement with the first electrical component. Opposing spring beams mechanically connect the engagement member to the base. The spring beams are configured to spread apart from each other as the engagement member is deflected in the compliance direction.

20 Claims, 7 Drawing Sheets

INTERCONNECT DEVICE

BACKGROUND OF THE INVENTION

The subject matter herein relates generally to interconnect devices for use between opposed arrays of contacts.

Interconnect devices are used to provide electrical connection between two or more opposing arrays of contacts for establishing at least one electrical circuit, where the respective arrays may be provided on various electrical components such as devices, printed circuit boards, Pin Grid Arrays (PGAs), Land Grid Arrays (LGAs), Ball Grid Arrays (BGAs), and/or the like. In one interconnect technique, the electrical connection is provided by an interconnect device that is physically interposed between corresponding electrical contacts of the opposing arrays of contacts.

At least some known interconnect devices use a plastic frame that defines a socket that receives an electrical component having one of the arrays of contacts. The plastic frame has deflectable spring fingers that locate the package in the socket. Such plastic frames are not without disadvantages. For example, as electrical components become smaller and smaller, the available space within the socket for holding and locating the electrical component also becomes smaller. The working range of the spring fingers may be inadequate for such smaller spaces such that the spring fingers lack the necessary compliance to both enable the electrical component to be inserted into the socket and also provide a sufficient spring force to hold and locate the electrical component within the socket. In other words, insertion of the electrical component into the socket may over-deflect the spring fingers past the working range thereof such that the spring fingers fail to exert a spring force that is sufficient to properly hold and locate the electrical component within the socket.

SUMMARY OF THE INVENTION

In one embodiment, an interconnect device includes a contact assembly having a carrier holding an array of conductors. Each of the conductors is configured to provide an electrical path between first and second electrical components such that the conductors electrically interconnect the first and second electrical components. The interconnect device also includes a frame defining a receiving space configured to receive the first electrical component therein. The frame includes corner frames that are configured to engage in physical contact with the first electrical component to locate the first electrical component within the receiving space. Each of the corner frames includes a base and an engagement member configured to engage in physical contact with the first electrical component as the first electrical component is received into the receiving space. The engagement member is configured to be resiliently deflected toward the base in a compliance direction via engagement with the first electrical component. Opposing spring beams mechanically connect the engagement member to the base. The spring beams are configured to spread apart from each other as the engagement member is deflected in the compliance direction.

In another embodiment, an interconnect device includes a contact assembly having a carrier holding an array of elastomeric columns. Each of the elastomeric columns is electrically conductive and is configured to provide an electrical path between first and second electrical components such that the elastomeric columns electrically interconnect the first and second electrical components. The interconnect device includes a frame defining a receiving space configured to receive the first electrical component therein. The frame includes corner frames that are configured to engage in physical contact with the first electrical component to locate the first electrical component within the receiving space. Each of the corner frames includes a base and an engagement member configured to engage in physical contact with the first electrical component as the first electrical component is received into the receiving space. The engagement member is configured to be resiliently deflected toward the base in a compliance direction via engagement with the first electrical component. Opposing spring beams mechanically connect the engagement member to the base. The spring beams are configured to spread apart from each other as the engagement member is deflected in the compliance direction.

In another embodiment, an interconnect device includes a contact assembly having a carrier holding an array of conductors. Each of the conductors is configured to provide an electrical path between first and second electrical components such that the conductors electrically interconnect the first and second electrical components. The interconnect device includes a frame defining a receiving space configured to receive the first electrical component therein. The frame includes at least one corner frame configured to engage in physical contact with the first electrical component to locate the first electrical component within the receiving space. The at least one corner frame comprises a base and an engagement member configured to engage in physical contact with the first electrical component as the first electrical component is received into the receiving space. The engagement member is configured to be resiliently deflected toward the base in a compliance direction via engagement with the first electrical component. Opposing spring beams mechanically connect the engagement member to the base. Each spring beam includes a base segment that extends outward from the base and a member segment that extends outward from the engagement member and is mechanically connected to the base segment. The base and member segments are angled with respect to each other at an angle that reduces as the engagement member is deflected in the compliance direction.

DETAILED DESCRIPTION OF SPECIFIC EMBODIMENTS OF THE INVENTION

Figure 1:
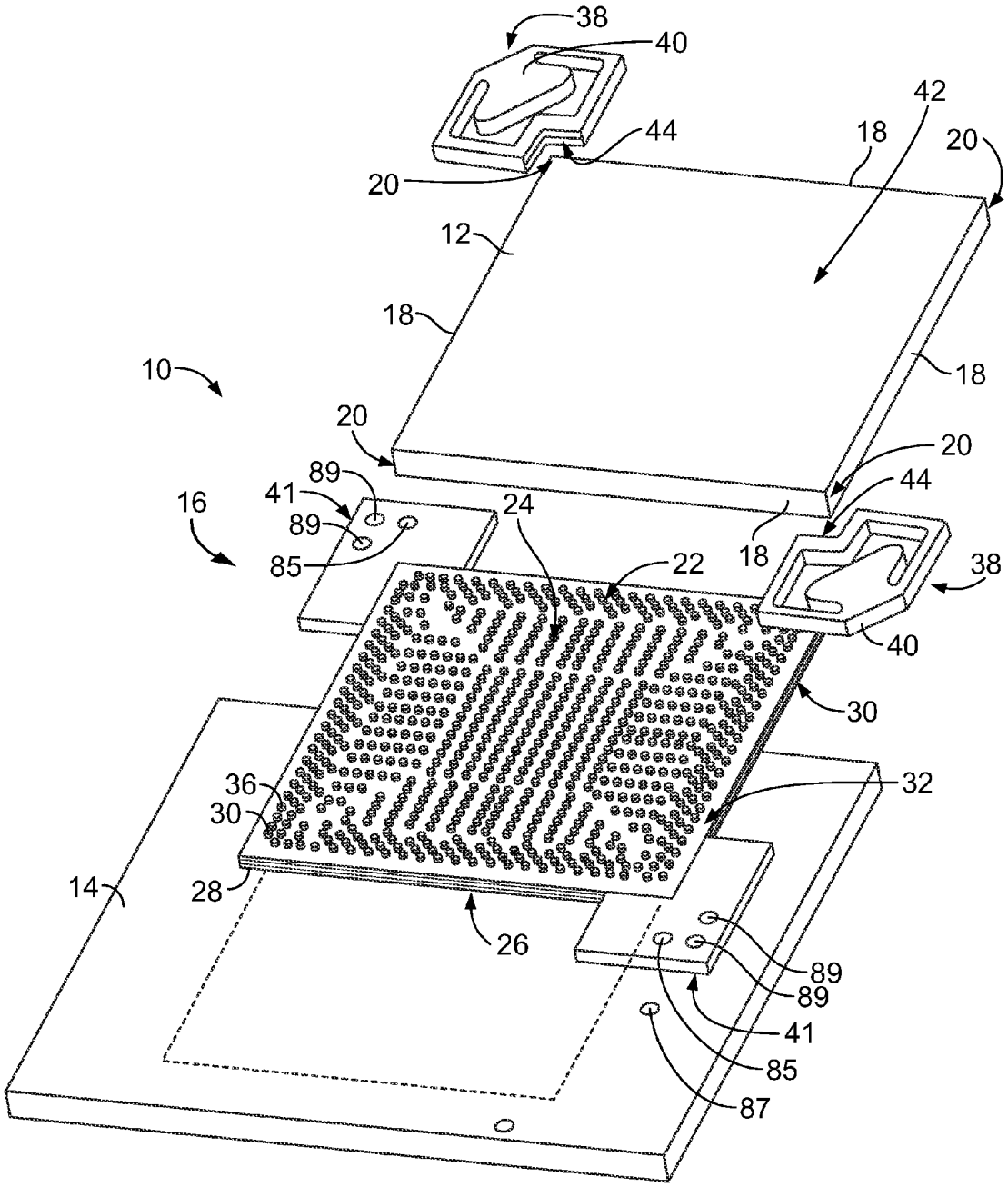
FIG. 1 is a partially exploded perspective view of an exemplary embodiment of an interconnect system.

FIG. 1 is partially exploded perspective view of an exemplary embodiment of an interconnect system 10. The system 10 includes a first electrical component 12, a second electrical component 14, and an interconnect device 16 therebetween. The interconnect device 16 is illustrated poised for mounting to the second electrical component 14. The first electrical component 12 is illustrated poised for mounting to the interconnect device 16. The first and second electrical components 12 and 14 both include an array of contacts, such as, but not limited to, ball grid arrays, land grid arrays, and/or the like that are electrically connected together by the interconnect device 16.

In the illustrated embodiment, the first electrical component 12 is an electronic package (such as, but not limited to, a chip, a processor, an integrated circuit, and/or the like) and the second electrical component 14 is a printed circuit board. In an exemplary embodiment, the interconnect device 16 constitutes a socket that is mounted to the printed circuit board and is configured to receive an electronic package. In other embodiments, other types of electrical components may be interconnected by the interconnect device 16. For example, both the first and second electrical components 12 and 14 may be printed circuit boards.

The first electrical component 12 includes a plurality of side edges 18 that intersect at corners 20 of the first electrical component 12. Each corner 20 includes a portion of the two corresponding side edges 18 that intersect at the corner 20. In the illustrated embodiment, the first electrical component 12 has a rectangular shape such that the first electrical component 12 includes four side edges 18 and four corners 20. But, the first electrical component 12 may have any other shape, any other number of side edges 18, and any other number of corners 20.

The interconnect device 16 includes a contact assembly 22 that is used to electrically interconnect the first and second electrical components 12 and 14. For example, the contact assembly 22 is configured to engage the arrays of contacts of the first and second electrical components 12 and 14. The contact assembly 22 has a first mating interface 24 and a second mating interface 26. The first mating interface 24 is configured to be electrically connected to the first electrical component 12. The second mating interface 26 is configured to be electrically connected to the second electrical component 14.

The contact assembly 22 of the interconnect device 16 includes an insulative carrier 28 holding an array of conductors 30. In the illustrated embodiment, the conductors 30 are elastomeric columns and may be referred to hereinafter as elastomeric columns 30. Other types of conductors may be used in alternative embodiments to define electrical paths through the contact assembly 22. For example, in addition or alternatively to the elastomeric columns 30, the conductors 30 may include electrical vias, electrical traces, solder balls, rigid metallic columns, electrical contacts, resiliently deflectable spring beams, pins, contact pads, and/or the like).

The insulative carrier 28 is fabricated from an insulative material, such as, but not limited to, a polyimide material that may be arranged as a polyimide film (e.g., a Kapton® material). The insulative carrier 28 may additionally or alternatively be fabricated from other insulative materials. The insulative carrier 28 may have one or more layers. For example, the insulative carrier 28 may have coverlays and bonding layers on first and second sides 32 and 34 of the carrier 28 that surround the elastomeric columns 30. The coverlays limit compression of the elastomeric columns 30. In some embodiments, the insulative carrier 28 is a printed circuit board.

The elastomeric columns 30 are arranged in an array having a predetermined pattern or layout that corresponds to the array of contacts of the first electrical component 12 and the second electrical component 14. The elastomeric columns 30 extend outward from both the first and second sides 32 and 34 of the insulative carrier 28. The elastomeric columns 30 extend between first ends 36 and second ends (not shown) that are opposite the first ends 36. In an exemplary embodiment, the elastomeric columns 30 are frustoconically shaped, being wider about the mid-section and narrower at the ends 36 thereof. But, the elastomeric columns 30 may additionally or alternatively include any other shape. The elastomeric columns 30 are held at the mid-sections by the insulative carrier 28. In an exemplary embodiment, the elastomeric columns 30 are electrically conductive elastomeric columns, such as, but not limited to, metalized particle interconnects (e.g., columns fabricated from a mixture of an elastic material and conductive flakes, and/or the like), columns having one or more internal and/or external electrical conductors (e.g., traces, pins, contacts, pads, vias, and/or the like), and/or the like. The elastomeric columns 30 provide conductive, electrical paths between the first ends 36 and the second ends thereof. Accordingly, when the mating interfaces 24 and 26 of the interconnect device 16 are mated with, and thereby electrically connected to, the electrical components 12 and 14, respectively, the elastomeric columns 30 provide electrical paths between the electrical components 12 and 14 such that the elastomeric columns 30 electrically interconnect the electrical components 12 and 14. The elastomeric columns 30 are at least partially compressible, for example when the first electrical component 12 is mounted to the contact assembly 22. In some embodiments, one or more metallic covers (not shown) are provided over the first ends 36 and/or the second ends of the elastomeric columns 30.

The interconnect device 16 includes a frame 38 having a plurality of corner frames 40. The corner frames 40 are separate from one another. The corner frames 40 define a receiving space 42 that receives the first electrical component 12. The corner frames 40 are configured to be mounted to the insulative carrier 28, such as, but not limited to, using one or more fasteners, latches, clips, clamps, posts, eyelets, and/or the like. In the illustrated embodiment, the corner frames 40 are configured to be mounted to mounting ears 41 of the insulative carrier 28. But, the corner frames 40 may additionally or alternatively be mounted to any other location along the insulative carrier 28. The corner frames 40 are configured to engage in physical contact with the first electrical component 12 to locate the first electrical component 12 within the receiving space 42. Specifically, and as will be described in more detail below, the corner frames 40 include resiliently deflectable engagement members 44 that engage in physical contact with corresponding corners 20 of the first electrical component 12. Although two are shown, the frame 38 may include any number of corner frames 40 necessary to engage the particular shape and/or configuration of the first electrical component 12. Each corner frame 40 may be formed from any materials, such as, but not limited to, a polymer, a plastic, a thermoplastic, a thermoset, a polyimide, a polyamide, polyetherimide, glass-filled polyetherimide, polyether ether ketone (PEEK), a metal, and/or the like.

Figure 2:
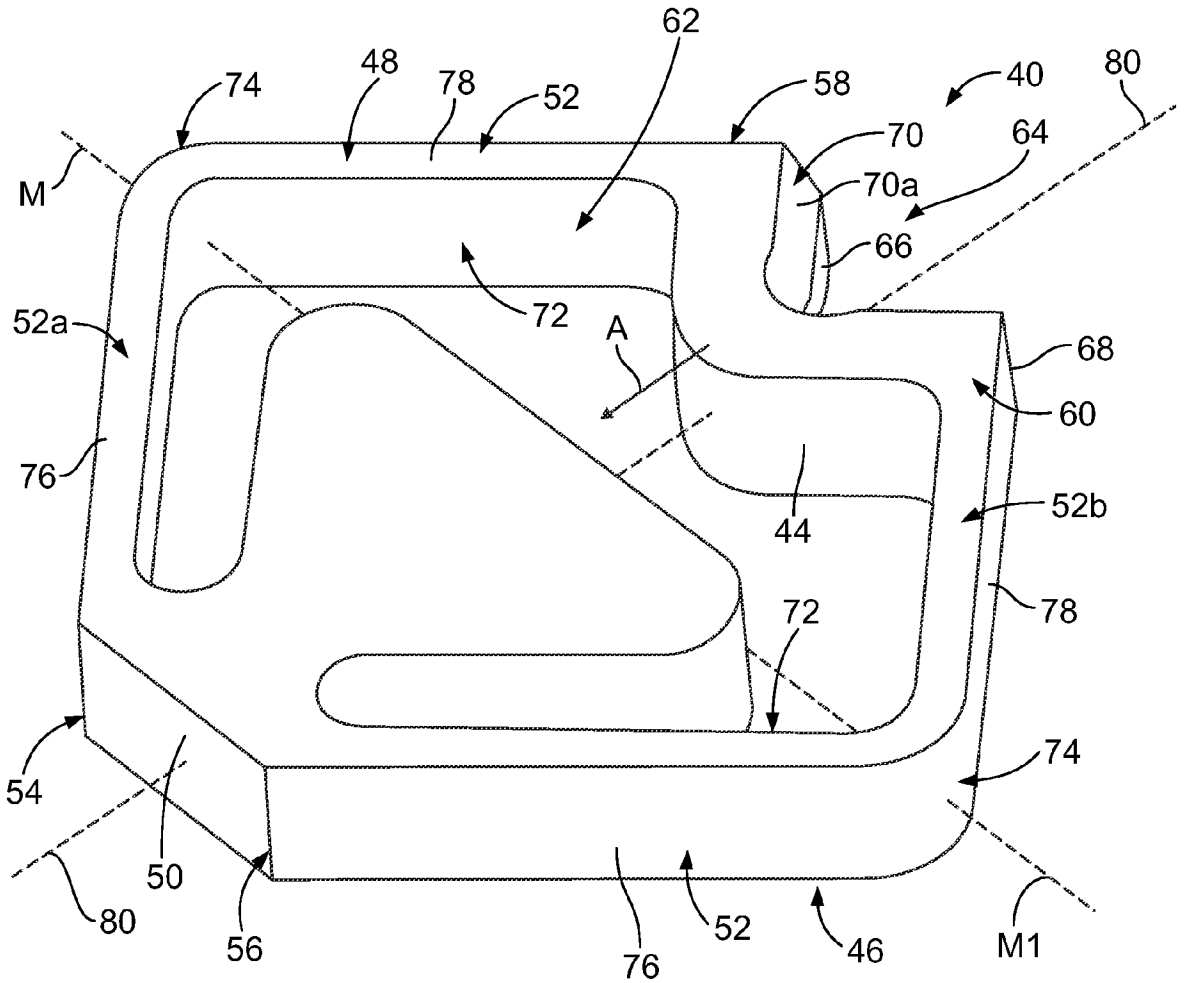
FIG. 2 is a perspective view of an exemplary embodiment of a corner frame of the interconnect system shown in FIG. 1.
Figure 3:
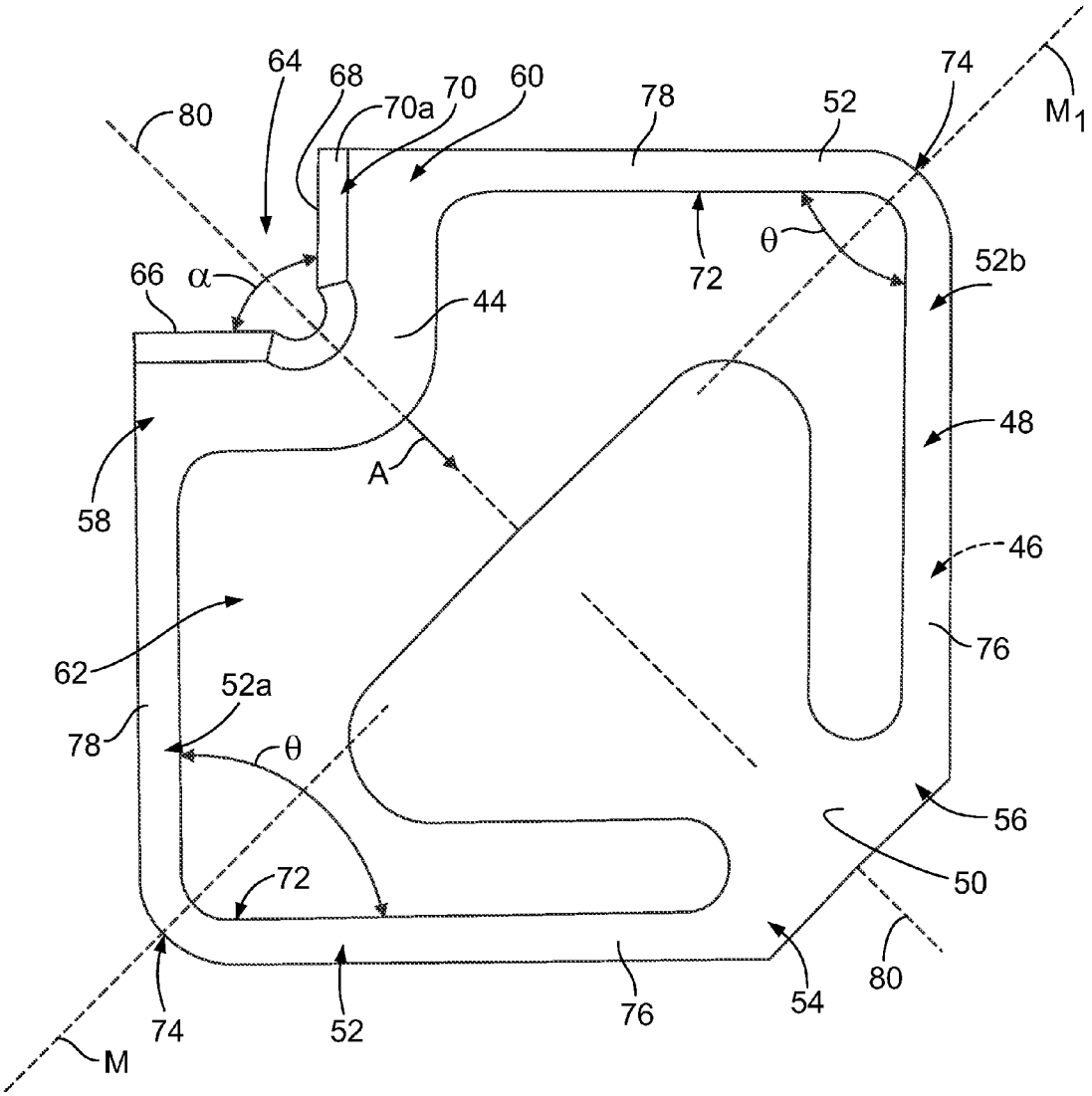
FIG. 3 is a plan view of the corner frame shown in FIG. 2.

FIG. 2 is a perspective view of an exemplary embodiment of one of the corner frames 40. FIG. 3 is a plan view of the corner frame 40 shown in FIG. 2. Referring now to FIGS. 2 and 3, the corner frame 40 includes a mounting side 46 and an opposite side 48. The mounting side 46 of the corner frame 40 is configured to face the insulative carrier 28 and the second electrical component 14 (FIGS. 1 and 10) when the corner frame 40 is mounted to the insulative carrier 28. The corner frame 40 includes a base 50, the engagement member 44, and opposing spring beams 52 that mechanically connect the engagement member 44 to the base 50. The base 50 includes opposite ends 54 and 56 and the engagement member 44 includes opposite ends 58 and 60. The opposing spring beams 52 include a first spring beam 52*a* and a second spring beam 52*b*. The first spring beam 52*a* extends from the end 54 of the base 50 to the end 58 of the engagement member 44. The second spring beam 52*b* extends from the end 56 of the base 50 to the end 60 of the engagement member 44. As can be seen in FIGS. 2 and 3, an interior space 62 of the corner frame 40 is defined between the engagement member 44, the base 50, and the spring beams 52*a* and 52*b*.

In the illustrated embodiment, the engagement member 44 includes a receiver socket 64 that is configured to receive a corresponding corner 20 (FIGS. 1 and 10) of the first electrical component 12 therein. The engagement member 44 is configured to engage in physical contact with the first electrical component 12 at the receiver socket 64. Specifically, the receiver socket 64 includes engagement surfaces 66 and 68 that are configured to engage in physical contact with corresponding side edges 18 of the corner 20 that is received within the receiver socket 64. In the illustrated embodiment, the engagement surfaces 66 and 68 of the receiver socket 64 extend at an angle α (labeled in FIG. 3) of approximately 90°, which provides the receiver socket 64 with a shape that is complementary to the approximately 90° corners 20 of the exemplary embodiment of the first electrical component 12. But, the engagement surfaces 66 and 68 may extend at any other angle relative to each other that provides the receiver socket 64 with any other shape. For example, the angle α between the engagement surfaces 66 and 68 may be selected such that the receiver socket 64 has a complementary shape relative to the differently angled corners 20 of a differently shaped first electrical component 12. Examples of other angles α between the engagement surfaces 66 and 68 include, but are not limited to, approximately 60° (e.g., to accommodate embodiments wherein the first electrical component 12 has the shape of an equilateral triangle), or approximately 120° (e.g., to accommodate embodiments wherein the first electrical component 12 has a hexagonal shape).

The engagement member 44 is not limited to having the receiver socket 64 for receiving a corner 20 of the first electrical component 12 therein. Rather, in some alternative embodiments, the engagement member 44 is configured to engage in physical contact with only one of the side edges 18 of the first electrical component 12. Moreover, the receiver socket 64 is not limited to having two discrete engagement surfaces 66 and 68 that are angled with respect to each other. Rather, instead of the angled shape shown in the exemplary embodiment, the receiver socket 64 may include a curved shape to accommodate embodiments wherein the first electrical component 12 has a curved shape (whether or not the curved shape received by the receiver socket 64 is a corner of the first electrical component 12). For example, the engagement surfaces 66 and 68 may define a continuous surface having a continuous radius of curvature to accommodate embodiments wherein the first electrical component 12 has a circular shape. Moreover, and for example, the engagement surfaces 66 and 68 may define a continuous surface having a non-continuous radius of curvature to accommodate embodiments wherein the first electrical component 12 has an oval shape.

Optionally, the engagement surfaces 66 and/or 68 of the engagement member 44 include guide features 70 that facilitate guiding the corresponding corner 20 of the first electrical component 12 into the receiver socket 64. In the illustrated embodiment, the guide feature 70 is a chamfer 70*a*. But, the guide feature 70 may include any other structure in addition or alternatively to the chamfer 70*a*.

Each of the spring beams 52*a* and 52*b* is a resiliently deflectable spring that is shown in FIGS. 2 and 3 in the natural resting position thereof. The spring beams 52 are operatively connected between the base 50 and the engagement member 44 such that the engagement member 44 is resiliently deflectable (against the bias of the spring beams 52 to the natural resting positions thereof) toward the base 50 in a compliance direction A.

As can be seen in FIGS. 2 and 3, the spring beams 52*a* and 52*b* oppose each other across the interior space 62. For example, interior sides 72 of the spring beams 52*a* and 52*b* oppose each other across the interior space 62. The spring beams 52 extend from the base 50 to the engagement member 44 along paths that are bent to define corners 74 of the spring beams 52. Specifically, each spring beam 52 includes a base segment 76 that extends outward from the base 50, and a member segment 78 that extends from the base segment 76 to the engagement member 44. The base segment 76 and the member segment 78 of each spring beam 52 are angled with respect to each other at an angle θ (not labeled in FIG. 2). The corner 74 of each spring beam 52 is defined at the intersection of the base segment 76 and the member segment 78. The path of each spring arm 52 thus has a "V" type shape that is defined by the two segments 76 and 78 that are angled with respect to each other and intersect at a general "point" (i.e., the corner 74) of the "V" shape. The angle θ (labeled in FIG. 3) of each spring beam 52 may have any value when the spring beam 52 is in the natural resting position. In the illustrated embodiment, the angle θ of each spring beam 52 is approximately 90° when the spring beam 52 is in the natural resting position, as is shown in FIGS. 2 and 3. As will be described below, the angle reduces (i.e., becomes smaller) when as the engagement member 44 is deflected in the compliance direction A. Regardless of the value of the angle θ between the segments 76 and 78, a spring beam 52 may be considered to have a "V" shaped path between the base 50 and the engagement member 44 when the spring beam 52 has two segments that are angled with respect to each other and intersect at a corner.

The base segment 76 of each spring beam 52 extends a length from the base 50 to the member segment 78, which extends a length from the base segment 76 to the engagement member 44. In the illustrated embodiment, the base segment 76 and the member segment 78 of the spring beam 52*a* have approximately the same length, and the base segment 76 and the member segment 78 of the spring beam 52*b* have approximately the same length, as can be seen in FIGS. 2 and 3. Accordingly, the corner 74 of the spring beam 52*a* is approximately aligned with a midpoint (shown by dotted line $M\text{-}M_1$) between the end 54 of the base 50 and the end 58 of the engagement member 44, and the corner 74 of the spring beam 52*b* is approximately aligned with the midpoint between the end 56 of the base 50 and the end 60 of the engagement member 44. Alternatively, the segments 76 and 78 of the spring beam 52*a* have different lengths, and/or the segments 76 and 78 of the spring beam 52*b* have different lengths. In embodiments wherein the segments 76 and 78 of a spring beam 52 have different lengths, the corner 74 of the spring beam 52 will be shifted away from the midpoint in a direction toward the base 50 or toward the engagement member 44, depending on which segment 76 or 78 is longer. Each segment 76 and 78 of each spring beam 52 may have various lengths in other embodiments.

Figure 4:
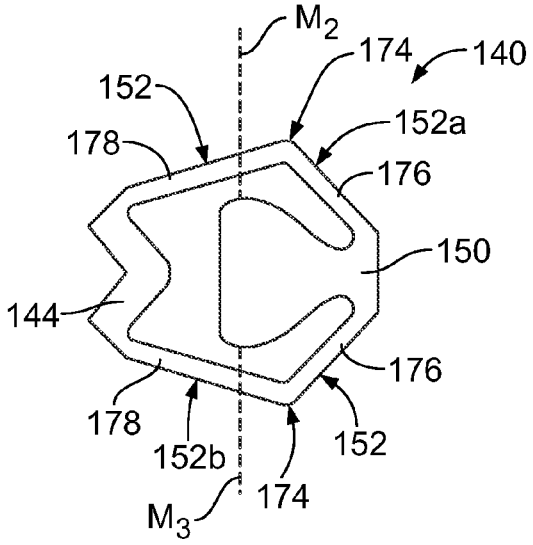
FIG. 4 is a plan view of another exemplary embodiment of a corner frame.

FIG. 4 is a plan view of an exemplary embodiment of a corner frame 140 that includes a spring beam 152 having segments 176 and 178 that have different lengths. The corner frame 140 includes two spring beams 152*a* and 152*b* that extend from a base 150 of the corner frame 140 to an engagement member 144 of the corner frame 140 along paths that are bent to define corners 174 of the spring beams 152*a* and 152*b*. As can be seen in FIG. 4, the length of the base segment 176 of the spring beam 152*a* is shorter than the length of the member segment 178 of the spring beam 152*a*, and the length of the base segment 176 of the spring beam 152*b* is shorter than the length of the member segment 178 of the spring beam 152*b*. Accordingly, the corner 174 of each spring beam 152*a* and 152*b* is shifted away from the midpoint shown by dotted line $M_2$-$M_3$ in a direction toward the base 150.

Figure 5:
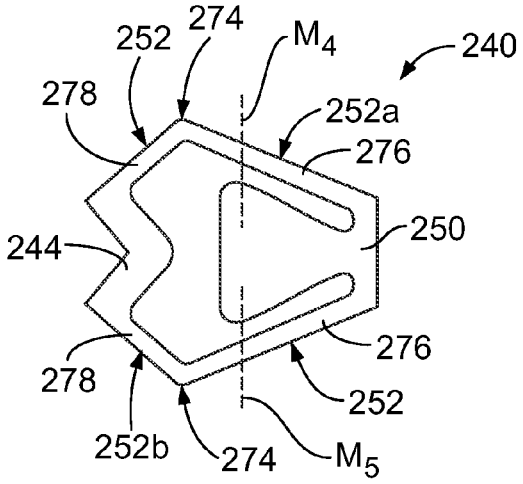
FIG. 5 is a plan view of another exemplary embodiment of a corner frame.

FIG. 5 is a plan view of another exemplary embodiment of a corner frame 240 that includes a spring beam 252 having segments 276 and 278 that have different lengths. The corner frame 240 includes two spring beams 252*a* and 252*b* that extend from a base 250 of the corner frame 240 to an engagement member 244 of the corner frame 240 along paths that are bent to define corners 274 of the spring beams 252*a* and 252*b*. The length of the base segment 276 of the spring beam 252*a* is longer than the length of the member segment 278 of the spring beam 252*a*, and the length of the base segment 276 of the spring beam 252*b* is longer than the length of the member segment 278 of the spring beam 252*b*. Accordingly, the corner 274 of each spring beam 252*a* and 252*b* is shifted away from the midpoint shown by dotted line $M_4$-$M_5$ in a direction toward the engagement member 244.

Figure 6:
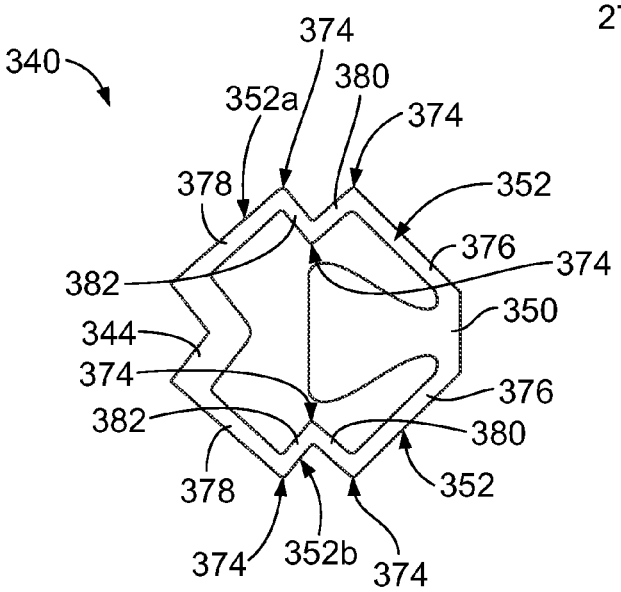
FIG. 6 is a plan view of another exemplary embodiment of a corner frame.

Referring again to FIGS. 2 and 3, each spring beam 52 is shown (and is described above) as having two segments, namely the base segment 76 and the member segment 78. But, each spring beam 52 may include any other number of segments. For example, FIG. 6 is a plan view of an exemplary embodiment of a corner frame 340 that includes a spring beam 352 having more than two segments. The corner frame 340 includes two spring beams 352*a* and 352*b* that extend from a base 350 of the corner frame 340 to an engagement member 344 of the corner frame 340. Each spring beam 352 includes a base segment 376 that extends outward from the base 350 and member segment 378 that extends outward from the engagement member 344. The base segment 376 and the member segment 378 are mechanically connected together by the intermediate segments 380 and 382. In other words, the two intermediate segments 380 and 382 extend between, and interconnect, the base segment 376 and the member segment 378. Specifically, the intermediate segment 380 extends from the base segment 376 at a corner 374 of the spring beam 352 and the intermediate segment 382 extends from the member segment 378 at another corner 374 of the spring beam 352. The intermediate segments 380 and 382 intersect at another corner 374 of the spring beam 352. The path of each spring arm 352 thus has a "W" type shape that is defined by the four segments 376, 378, 380, and 382 that are angled with respect to each other and intersect at general "points" (i.e., the corners 374) of the "W" shape.

Figure 7:
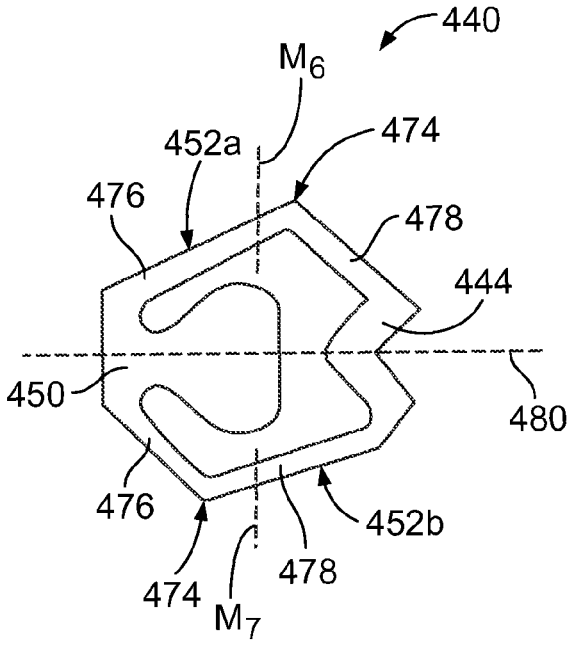
FIG. 7 is a plan view of yet another exemplary embodiment of a corner frame.

Referring again to FIGS. 2 and 3, the spring beams 52*a* and 52*b* of the corner frame 40 are shown and described herein as being configured substantially identically. For example, the paths of the spring beams 52*a* and 52*b* from the base 50 to the engagement member 44 have substantially the same shape such that the corner frame 40 is symmetrical (with respect to the spring beams 52) about a central axis 80 along which the base 50 and the engagement member 44 are aligned. But, in other embodiments, the spring beams 52*a* and 52*b* may be differently configured. For example, the paths of the spring beams 52*a* and 52*b* from the base 50 to the engagement member 44 may have different shapes than each other. FIG. 7 is a plan view of an exemplary embodiment of a corner frame 440 that includes spring beams 452*a* and 452*b* that are configured differently. Specifically, the length of a base segment 476 of the spring beam 452*a* is longer than the length of a member segment 478 of the spring beam 452*a* such that a corner 474 of the spring beam 452*a* is shifted away from the corresponding midpoint shown as dotted line $M_6$-$M_7$ in a direction toward the engagement member 444. In contrast, the length of a base segment 476 of the spring beam 452*b* is shorter than the length of a member segment 478 of the spring beam 452*b* such that a corner 474 of the spring beam 452*b* is shifted away from the midpoint in a direction toward the base 450. Accordingly, the corner frame 440 is asymmetrical (with respect to the spring beams 452*a* and 452*b*) about a central axis 480 along which the base 450 and the engagement member 444 are aligned.

Figure 8:
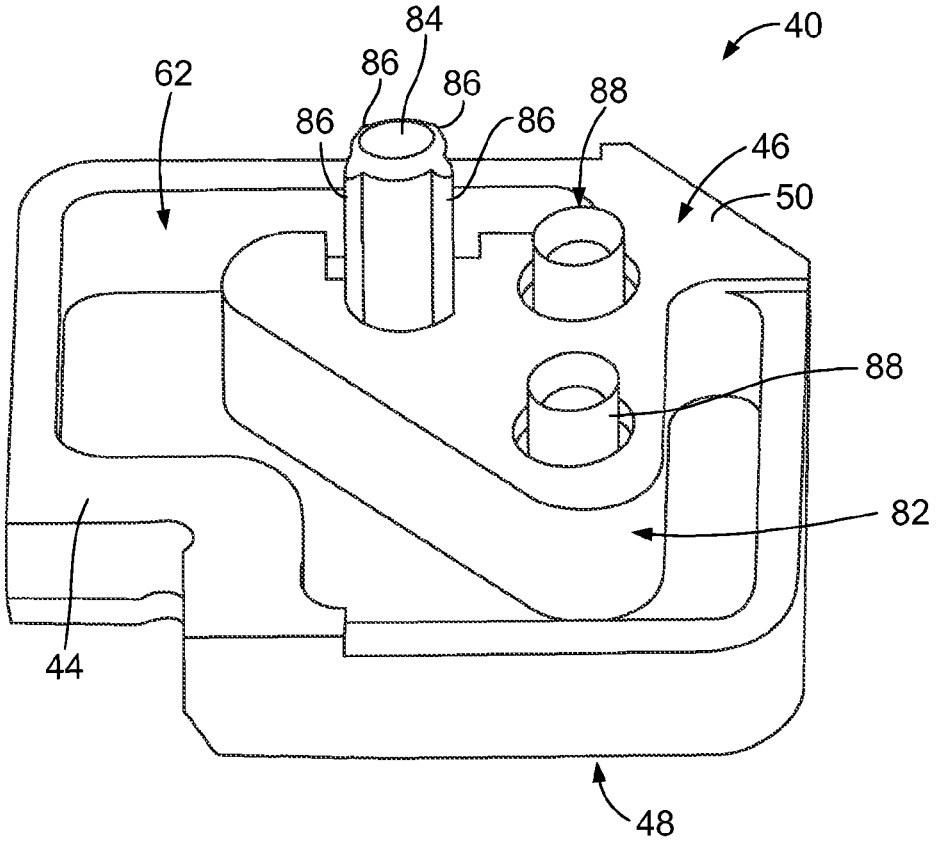
FIG. 8 is a perspective view of the corner frame shown in FIGS. 2 and 3 illustrating an exemplary embodiment of a mounting side 46 of the corner frame.

FIG. 8 is a perspective view of the corner frame 40 illustrating an exemplary embodiment of the mounting side 46 of the corner frame 40. The corner frame 40 includes a mounting platform 82 that extends from the base 50 into the interior space 62 and includes one or more locating posts 84 extending outward on the mounting side 46 of the corner frame 40. The mounting platform 82 of corner frame 40 also provides a certain mass within the interior space 62 that contributes to providing overall mechanical strength and stability to the corner frame 40. The locating post 84 is configured to be received through a corresponding opening 85 (FIG. 1) in the insulative carrier 28 (FIG. 1) and into a corresponding opening 87 in second electrical component 14 (FIGS. 1 and 10) to locate the corner frame 40 with respect to the second electrical component 14. In an exemplary embodiment, the locating post 84 is integrally formed with the mounting platform 82 and/or the base 50. For example, the locating post 84 may be injection molded along with all or a portion of the remainder (e.g., the mounting platform 82, the base 50, the engagement member 44, and/or the spring beams 52) of the corner frame 40. Alternatively, the locating post 84 may be a discrete component that is coupled or otherwise affixed to the mounting platform 82 and/or the base 50. The locating post 84 optionally includes one or more crush ribs 86 for creating an interference fit with the corresponding opening 85 and/or 87 of the insulative carrier 28 and the second electrical component 14, respectively. In addition or alternatively to the mounting platform 82, the corner frame 40 may include one or more locating posts 84 on the base 50. The corner frame 40 may include any number of locating posts 84, each of which may include any number of crush ribs 86.

The corner frame 40 may include one or more fasteners 88 for securing the corner frame 40 to the insulative carrier 28. In an exemplary embodiment, the fasteners 88 are formed integral with the mounting platform 82 and/or the base 50. For example, the fasteners 88 may be injection molded along with all or a portion of the remainder (e.g., the mounting platform 82, the base 50, the engagement member 44, and/or the spring beams 52) of the corner frame 40. Alternatively, the fasteners 88 are discrete components that are coupled or otherwise affixed to the mounting platform 82 and/or the base 50. In the illustrated embodiment, the fasteners 88 are eyelets that may be forged or swaged (i.e., cold staked) to corresponding openings 89 (FIG. 1) of the insulative carrier 28 to secure the corner frame 40 to the insulative carrier 28. The fasteners 88 may be secured to the insulative carrier 28 by other means or processes in alternative embodiments. For example, the fasteners 88 may be tabs that are pressed through corresponding slots (not shown) in the insulative carrier 28 and bent or crimped to the carrier 28. Other types of fasteners 88 may be used to secure the corner frame 40 to the insulative carrier 28, such as, but not limited to, a post that is received within openings of the insulative carrier 28 with a snap fit and/or an interference fit. Moreover, and for example, the fasteners 88 may be discrete components that are coupled to the corner frame 40 and the insulative carrier, such as, but not limited to, threaded fasteners, latches, clips, clamps, and/or the like. Although two are shown, the corner frame 40 may include any number of fasteners 88.

Figure 9:
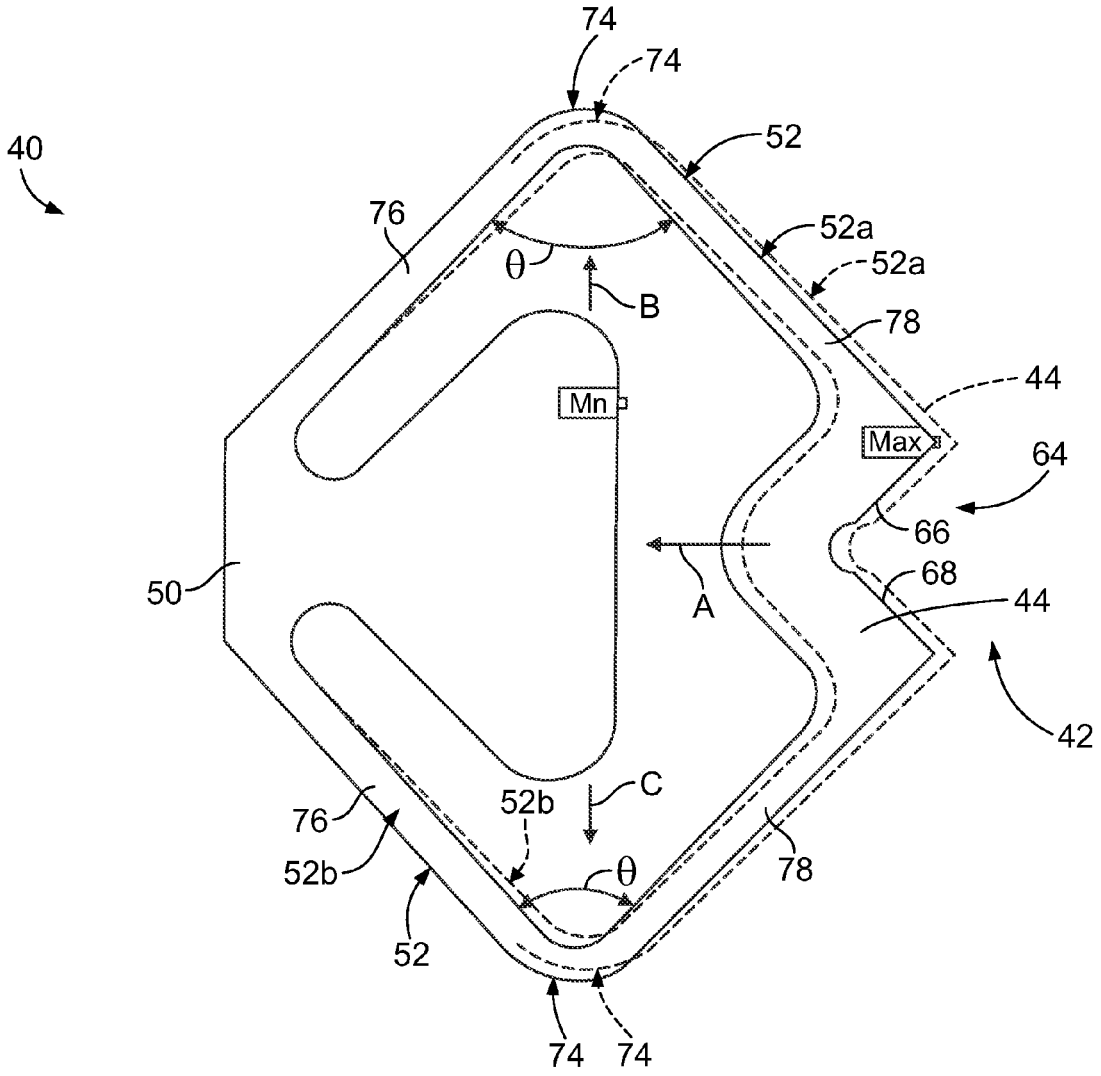
FIG. 9 is plan view of the corner frame shown in FIGS. 2, 3, and 8 illustrating an exemplary embodiment of resilient deflection of an exemplary embodiment of an engagement member of the corner frame.

FIG. 9 is plan view of the corner frame 40 illustrating an exemplary embodiment of resilient deflection of the engagement member 44 in the compliance direction A. As described above, each of the spring beams 52*a* and 52*b* is a resiliently deflectable spring that is operatively connected between the base 50 and the engagement member 44 such that the engagement member 44 is resiliently deflectable (against the bias of the spring beams 52 to the natural resting positions thereof) toward the base 50 in the compliance direction A. The engagement member 44 is shown in FIG. 9 as being at least partially deflected toward the base 50 in the compliance direction A. The natural resting positions of the engagement member 44 and the spring beams 52*a* and 52*b* are shown in phantom in FIG. 9 to illustrate the deflection of the engagement member 44.

As the first electrical component 12 (FIGS. 1 and 10) is received into the receiving space 42, the engagement surfaces 66 and 68 engage in physical contact with corresponding side edges 18 (FIGS. 1 and 10) of the corner 20 (FIGS. 1 and 10) that is received within the receiver socket 64 of the corner frame 40. As the corner 20 of the first electrical component 12 engages in physical contact with the engagement surfaces 66 and 68, the engagement member 44 is resiliently deflected (against the bias of the spring beams 52) toward the base 50 in the compliance direction A. As can be seen in FIG. 9, as the engagement member 44 is deflected in the compliance direction A, the angle θ between the segments 76 and 78 of each spring beam 52 reduces (i.e., becomes smaller). Moreover, the spring beams 52*a* and 52*b* spread apart from each other as the engagement member 44 is deflected in the compliance direction A, as can also be seen in FIG. 9. For example, the corners 74 (i.e., the general "points" of the "V" shape) of the spring beams 52*a* and 52*b* spread apart from each other.

In the illustrated embodiment, the spring beams 52*a* and 52*b* spread apart from each other in respective directions B and C that are approximately perpendicular to the compliance direction A. However, the spring beams 52*a* and 52*b* may spread apart from each other in any other transverse directions relative to the compliance direction A. The deflection of the engagement member 44 and the spring beams 52 operates similar to a conventional scissor jack (not shown) in that the corners 74 spread apart and the angle θ reduces as the engagement member 44 deflects in the compliance direction. The amount of deflection of the engagement member 44 in the compliance direction A shown in FIG. 9 is meant as exemplary only. The engagement member 44 may deflect in the compliance direction by any other amount (whether more or less) than is shown herein. Similarly, the spring beams 52*a* and 52*b* may spread apart by any other amount (whether more or less), and the angle θ may reduce by any other amount (whether more or less), than is shown herein.

Figure 10:
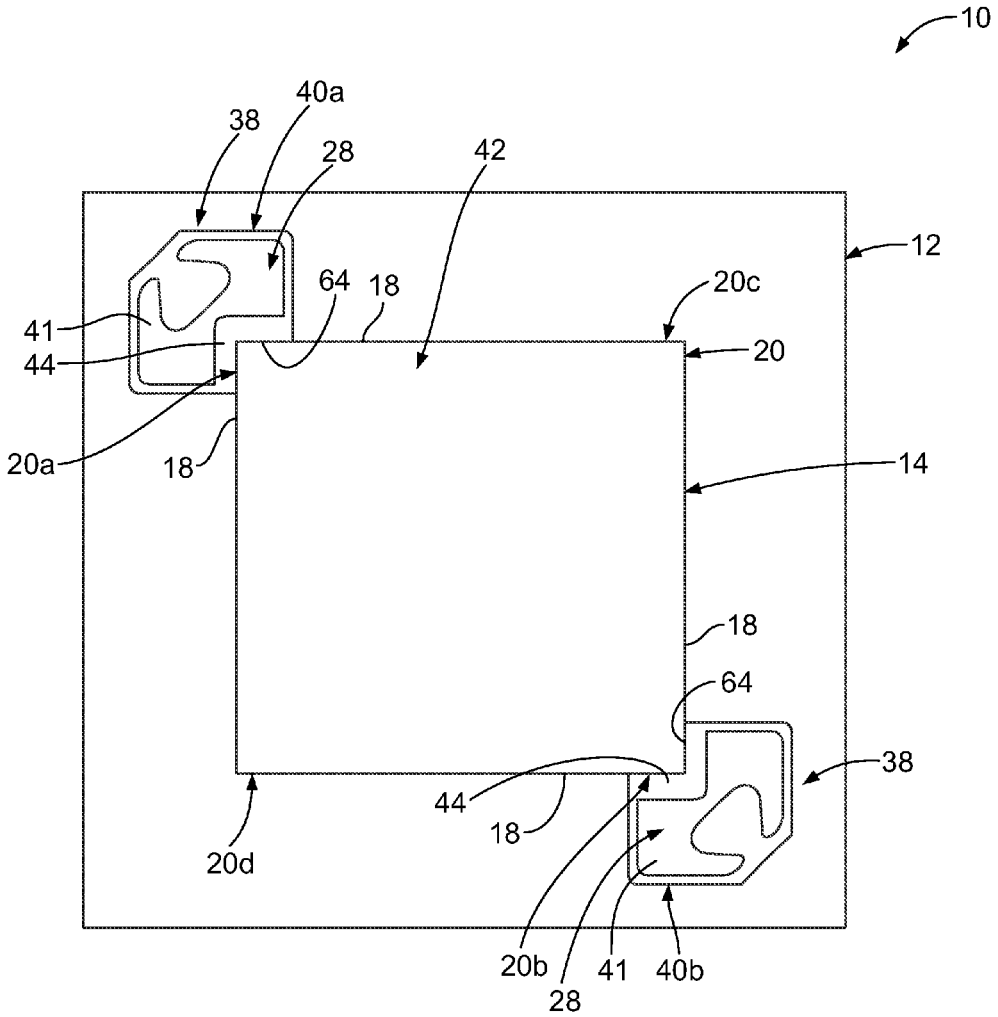
FIG. 10 is a plan view of the assembled interconnect system shown in FIG. 1.

FIG. 10 is a plan view of the interconnect system 10. In the illustrated embodiment, the frame 38 includes two corner frames 40*a* and 40*b*, which are shown in FIG. 10 mounted to the mounting ears 41 of the insulative carrier 28. The first electrical component 12 is received within the receiving space 42 of the frame 38. Opposite corners 20*a* and 20*b* of the first electrical component 12 are received within the receiving sockets 64 of the corner frames 40*a* and 40*b*, respectively. The engagement members 44 of the corner frames 40*a* and 40*b* are engaged in physical contact with the side edges 18 of the respective corner 20*a* and 20*b*, and have been resiliently deflected, to locate the first electrical component 12 within the receiving space 42.

Although shown as including two corner frames 40*a* and 40*b*, the frame 38 may include additional corner frames 40. For example, the frame 38 may include a corner frame 40 that engages in physical contact with a corner 20*c* of the first electrical component 12 and/or the frame 38 may include a corner frame 40 that engages in physical contact with a corner 20*d* of the first electrical component 12. In some embodiments, the corner frames 40 are not limited to engaging opposite corners 20 of the first electrical component 12. For example, the frame 38 may include two corner frames 40 that engage in physical contact with two adjacent corners 20 (e.g., the corners 20*a* and 20*c*) of the first electrical component 12. In some embodiments, the frame 38 may include only a single corner frame 40 which could be used in concert with a standard-sized center biased frame in the opposite corner as the corner frame 40. Moreover, the frame 38 could include one or more corner and/or side edge members (not shown) that includes a rigid engagement member that engages in physical contact with a corresponding corner 20 and/or one or more corresponding side edges 18 of the first electrical component 12 without resiliently deflection. For example, such corner and/or side edge members may be positioned opposite a corner frame 40.

The embodiments described and/or illustrated herein may provide a frame having an engagement member that has sufficient compliance to enable an electrical component to be inserted into a receiving space of the frame while also providing a sufficient spring force to hold and locate the electrical component within the receiving space. The embodiments described and/or illustrated herein may provide a frame that is capable of holding and locating an electrical component within a smaller receiving space than the frames of at least some known interconnect devices.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An interconnect device comprising:

a contact assembly having a carrier holding an array of conductors, each of the conductors being configured to provide an electrical path between first and second electrical components such that the conductors electrically interconnect the first and second electrical components; and a frame defining a receiving space configured to receive the first electrical component therein, the frame comprising corner frames that are configured to engage in physical contact with the first electrical component to locate the first electrical component within the receiving space, wherein each of the corner frames comprises:

a base;

an engagement member configured to engage in physical contact with the first electrical component as the first electrical component is received into the receiving space, the engagement member being configured to be resiliently deflected toward the base in a compliance direction via engagement with the first electrical component; and opposing spring beams that mechanically connect the engagement member to the base, wherein the spring beams are configured to spread apart from each other as the engagement member is deflected in the compliance direction.

2. The interconnect device of claim 1, wherein the spring beams are configured to spread apart from each other in directions that are transverse to the compliance direction.

3. The interconnect device of claim 1, wherein the spring beams extend from the base to the engagement member along paths that are bent to define corners of the spring beams, the corners of the opposing spring beams being configured to spread apart from each other as the engagement member is deflected in the compliance direction.

4. The interconnect device of claim 1, wherein each spring beam comprises a base segment that extends outward from the base and a member segment that extends from the base segment to the engagement member, the base and member segments being angled with respect to each other at an angle that reduces as the engagement member is deflected in the compliance direction.

5. The interconnect device of claim 1, wherein the spring beams extend along V-shaped paths from the base to the engagement member, points of the V-shapes being configured to spread apart from each other as the engagement member is deflected in the compliance direction.

6. The interconnect device of claim 1, wherein the base and the engagement member are aligned along a central axis, the corner frame being symmetrical with respect to the spring beams about the central axis.

7. The interconnect device of claim 1, wherein the engagement member comprises a receiver socket that is configured to receive a corner of the first electrical component therein, the engagement member being configured to engage in physical contact with the first electrical component at the receiver socket.

8. The interconnect device of claim 1, wherein each spring beam comprises a base segment that extends a length outward from the base and a member segment that extends a length from the base segment to the engagement member, the base and member segments being angled with respect to each other, the base and member segments having approximately the same length.

9. The interconnect device of claim 1, wherein the spring beams extend from the base to the engagement member along paths that are bent to define corners of the spring beams, the corners of the spring beams being approximately aligned with midpoints between ends of the base and the engagement member from which the spring beams extend.

10. The interconnect device of claim 1, wherein the corner frames comprise a first corner frame and a second corner frame arranged on opposite corners of the first electrical component.

11. The interconnect device of claim 1, wherein the corner frames comprise locating posts for locating the corner frames with respect to the second electrical component.

12. The interconnect device of claim 1, wherein the corner frames comprise integral fasteners for securing the corner frames to the second electrical component.

13. The interconnect device of claim 1, wherein the spring beams are configured to spread apart from each other in directions that are approximately perpendicular to the compliance direction.

14. An interconnect device comprising:

a contact assembly having a carrier holding an array of elastomeric columns, each of the elastomeric columns being electrically conductive and being configured to provide an electrical path between first and second electrical components such that the elastomeric columns electrically interconnect the first and second electrical components; and a frame defining a receiving space configured to receive the first electrical component therein, the frame comprising corner frames that are configured to engage in physical contact with the first electrical component to locate the first electrical component within the receiving space, wherein each of the corner frames comprises:

a base;

an engagement member configured to engage in physical contact with the first electrical component as the first electrical component is received into the receiving space, the engagement member being configured to be resiliently deflected toward the base in a compliance direction via engagement with the first electrical component; and opposing spring beams that mechanically connect the engagement member to the base, wherein the spring beams are configured to spread apart from each other as the engagement member is deflected in the compliance direction.

15. The interconnect device of claim 14, wherein the spring beams are configured to spread apart from each other in directions that are transverse to the compliance direction.

16. The interconnect device of claim 14, wherein the spring beams extend along V-shaped paths from the base to the engagement member, points of the V-shapes being configured to spread apart from each other as the engagement member is deflected in the compliance direction.

17. The interconnect device of claim 14, wherein each spring beam comprises a base segment that extends outward from the base and a member segment that extends from the base segment to the engagement member, the base and member segments being angled with respect to each other at an angle that reduces as the engagement member is deflected in the compliance direction.

18. The interconnect device of claim 14, wherein the engagement member comprises a receiver socket that is configured to receive a corner of the first electrical component therein, the engagement member being configured to engage in physical contact with the first electrical component at the receiver socket.

19. The interconnect device of claim 14, wherein each spring beam comprises a base segment that extends a length outward from the base and a member segment that extends a length from the base segment to the engagement member, the base and member segments being angled with respect to each other, the base and member segments having approximately the same length.

20. An interconnect device comprising:

a contact assembly having a carrier holding an array of conductors, each of the conductors being configured to provide an electrical path between first and second electrical components such that the conductors electrically interconnect the first and second electrical components; and a frame defining a receiving space configured to receive the first electrical component therein, the frame comprising at least one corner frame configured to engage in physical contact with the first electrical component to locate the first electrical component within the receiving space, wherein the at least one corner frame comprises:

a base;

an engagement member configured to engage in physical contact with the first electrical component as the first electrical component is received into the receiving space, the engagement member being configured to be resiliently deflected toward the base in a compliance direction via engagement with the first electrical component; and opposing spring beams that mechanically connect the engagement member to the base, each spring beam comprising a base segment that extends outward from the base and a member segment that extends outward from the engagement member and is mechanically connected to the base segment, the base and member segments being angled with respect to each other at an angle that reduces as the engagement member is deflected in the compliance direction.

* * * * *